US009285744B1

(12) United States Patent
Umenaga et al.

(10) Patent No.: US 9,285,744 B1
(45) Date of Patent: Mar. 15, 2016

(54) IMAGE FORMING APPARATUS AND IMAGE FORMING SYSTEM INCLUDING THE SAME

(71) Applicant: KYOCERA Document Solutions Inc., Osaka (JP)

(72) Inventors: Akihiro Umenaga, Osaka (JP); Rie Kasai, Osaka (JP); Hiroshi Nakamura, Osaka (JP); Satomi Murai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/839,760

(22) Filed: Aug. 28, 2015

(30) Foreign Application Priority Data

Sep. 1, 2014 (JP) ..... 2014-177213

(51) Int. Cl.
*G03G 15/00* (2006.01)

(52) U.S. Cl.
CPC ..... *G03G 15/5091* (2013.01)

(58) Field of Classification Search
CPC ..... G03G 15/5075; G03G 15/5091
See application file for complete search history.

(56) References Cited

U.S. PATENT DOCUMENTS 7,865,445 B2 * 1/2011 Maeda ..... G06F 21/105 235/379
2007/0198427 A1 * 8/2007 Vajjiravel ..... G06Q 30/06 705/59

FOREIGN PATENT DOCUMENTS

JP 2009303117 A * 12/2009
JP 2010-165101 A 7/2010

* cited by examiner

*Primary Examiner* — Gregory H Curran
(74) *Attorney, Agent, or Firm* — Stein IP, LLC

(57) ABSTRACT

An image forming apparatus includes a storage unit for storing a primary key issued by an activation key issuing system and storing a key issuing program, a reception unit for receiving an instruction to issue an activation key that can be used in another image forming apparatus in a local network, a control unit configured to generate the activation key that can be used in the another image forming apparatus on the basis of the primary key and the key issuing program, and a printing unit configured to print generated key information to be input to the another image forming apparatus when using the activation key generated by the control unit in the another image forming apparatus on a sheet to output the sheet.

7 Claims, 10 Drawing Sheets

IMAGE FORMING APPARATUS AND IMAGE FORMING SYSTEM INCLUDING THE SAME

INCORPORATION BY REFERENCE

This application is based upon and claims the benefit of priority from the corresponding Japanese Patent Application No. 2014-177213 filed Sep. 1, 2014, the entire contents of which are incorporated herein by reference.

BACKGROUND

The present disclosure relates to an image forming apparatus storing an application that is activated with an activation key and an image forming system including the image forming apparatus.

Conventionally, there is an image forming apparatus to which an application (program) can be additionally installed. However, there is a case where the application cannot be used only by installing the application in the image forming apparatus (without obtaining a license). In this case, it is necessary to request for license to the manufacturer or dealer of the application to receive an issue of the license.

For instance, there is conventionally known a network device (multifunction peripheral) that obtains an application from an application server system via a network. This network device obtains a license necessary for activating the newly installed application from the application server system via a network.

SUMMARY

An image forming apparatus according to a first aspect of the present disclosure includes a storage unit, a reception unit, a control unit, and a printing unit. The storage unit stores a primary key as an activation key issued from an external official activation key issuing system and also stores a key issuing program for additionally issuing the activation key based on the primary key. The reception unit receives an instruction to issue the activation key that can be used in another image forming apparatus belonging to the same local network as the image forming apparatus, the another image forming apparatus being installed with an inactivated application. When the reception unit receives the instruction to issue the activation key, the control unit generates the activation key that can be used in the another image forming apparatus, on the basis of the primary key and the key issuing program. The printing unit prints generated key information to be input to the another image forming apparatus when using the activation key generated by the control unit in the another image forming apparatus on a sheet to output the sheet.

An image forming system according to a second aspect of the present disclosure includes a first image forming apparatus that is the above-mentioned image forming apparatus and a second image forming apparatus. The second image forming apparatus is an image forming apparatus in which an inactivated application is installed and is an image forming apparatus other than the first image forming apparatus, belonging to the same local network as the first image forming apparatus. The second image forming apparatus activates the application when the generated key information is input to the second image forming apparatus.

DETAILED DESCRIPTION

<Outline of Image Forming System>

Figure 1:
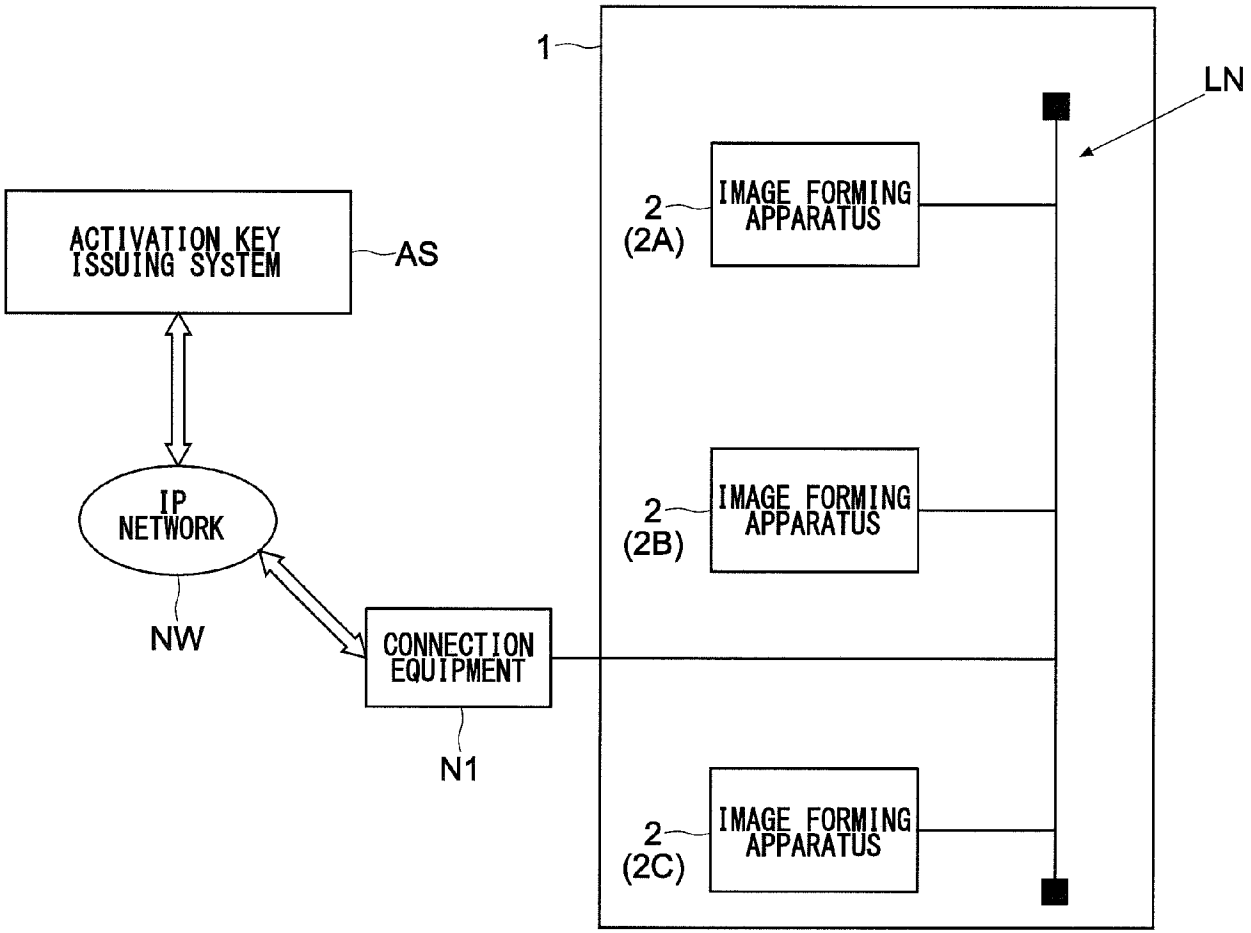
FIG. 1 is a schematic diagram of an image forming system according to an embodiment of the present disclosure.

As shown in FIG. 1, an image forming system 1 of this embodiment includes a plurality of image forming apparatuses 2 (image forming apparatuses 2A, 2B and 2C). For instance, the image forming apparatus 2 included in the image forming system 1 is a multifunction peripheral having functions such as a copy function and a transmission function (FAX function). Note that the number of the image forming apparatuses 2 included in the image forming system 1 is not limited to a specific number. It is sufficient that the number is two or more (may be four or more). In addition, the image forming apparatuses 2 included in the image forming system 1 may have the same structure or may have different structures. In the following description, it is supposed that the image forming apparatuses 2 included in the image forming system 1 have the same structure as an example.

The plurality of image forming apparatuses 2 are connected to each other in a communicable manner (e.g., via Ethernet) in a local network LN. In other words, the plurality of image forming apparatuses 2 are connected to each other in a communicable manner via LAN.

The local network LN is connected to an outside network (e.g., an IP network NW) via a connection equipment N1 such as a gateway (or a router). In other words, a terminal side of the connection equipment N1 corresponds to the local network LN.

Here, an application AP (see FIG. 3) for extending functions of the image forming apparatus 2 may be installed in the image forming apparatus 2. For instance, the image forming apparatus 2 is shipped in a state where the application AP is installed in advance. Alternatively, the application AP may be installed in the image forming apparatus 2 after shipping the image forming apparatus 2. However, this application AP cannot be used only by installing it in the image forming apparatus 2. In order to use the application AP in the image forming apparatus 2, an activation key for activating the application AP (protect release key for releasing protection of the application AP) is necessary. For this reason, the image forming apparatus 2 is connected to an activation key issuing system AS in a communicable manner via the IP network NW.

The activation key issuing system AS is an official license management server established by a developer or a dealer of the application AP, for example, and is a provider of the activation key. When the activation key issuing system AS receives a request for issuing the activation key from the image forming apparatus 2 (a user thereof), the activation key issuing system AS checks the content of the request for issue. Then, when there is no irregularity in the request for issue of the activation key (e.g., when there is no matching with a predetermined condition regarded as irregularity), the activation key issuing system AS generates the activation key and issues the activation key to the image forming apparatus 2 as a requester. In this way, the image forming apparatus 2 as a requester can activate the application AP by the activation key issued from the activation key issuing system AS.

<Structure of Image Forming Apparatus>

Figure 2:
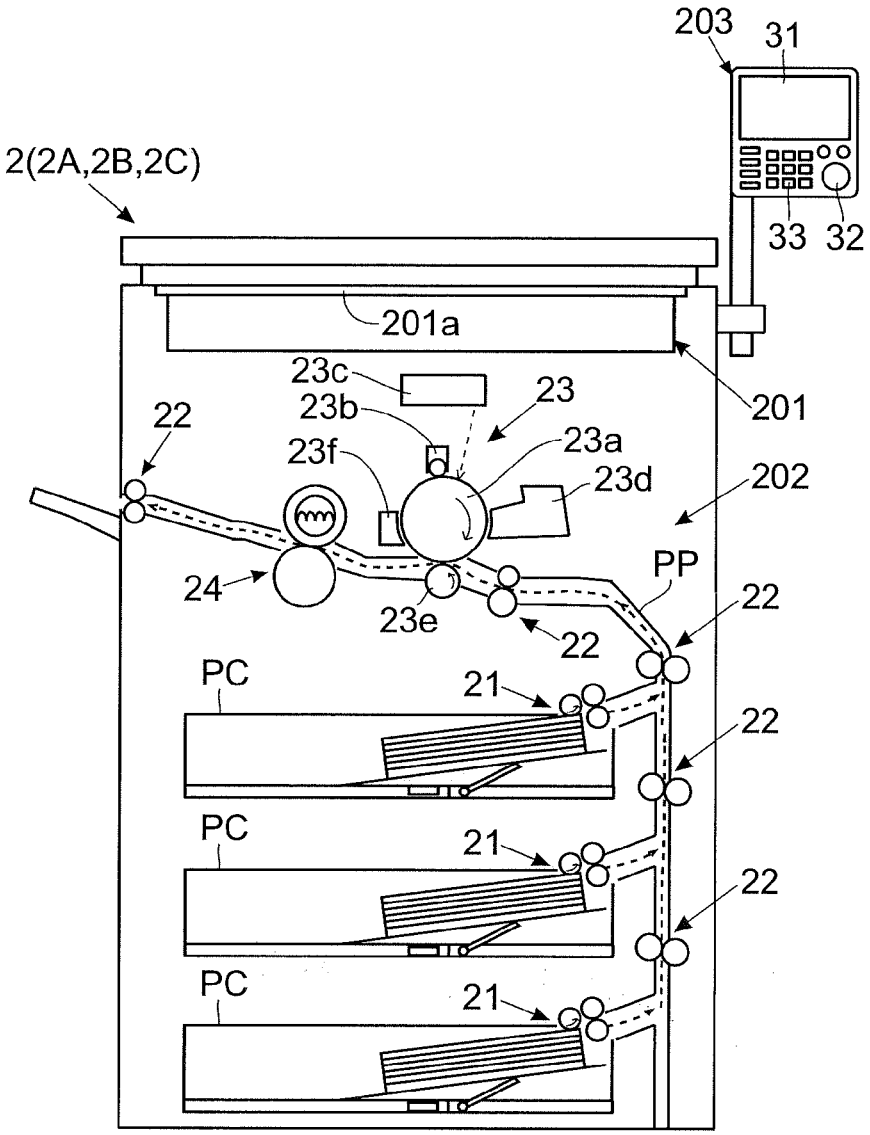
FIG. 2 is a schematic diagram of an image forming apparatus according to an embodiment of the present disclosure.

As shown in FIG. 2, the image forming apparatus 2 includes an image reading unit 201, a printing unit 202, and an operation panel 203. Note that the operation panel 203 corresponds to a "reception unit".

The image reading unit 201 includes a contact glass 201*a* and reads a document on the contact glass 201*a* so as to generate image data of the document. For instance, the image data of the document obtained by reading by the image reading unit 201 undergo various processes performed by a main control unit 210 (see FIG. 3) described later. Further, the image data become basic data for printing an image by the printing unit 202. Alternately, the image data become basic data of facsimile data.

The printing unit 202 includes a sheet feeder 21, a sheet conveying unit 22, an image forming unit 23, and a fixing unit 24. The sheet feeder 21 feeds paper sheets stored in a paper sheet cassette PC to a sheet conveying path PP. The sheet conveying unit 22 conveys a paper sheet along the sheet conveying path PP. The image forming unit 23 includes a photosensitive drum 23*a*, a charging device 23*b*, an exposing device 23*c*, a developing device 23*d*, a transfer roller 23*e*, and a cleaning device 23*f*. Then, the image forming unit 23 forms a toner image based on the image data and transfers the toner image onto the paper sheet. The fixing unit 24 heats and presses the toner image transferred onto the paper sheet so as to fix the toner image.

The operation panel 203 includes a display panel 31 with a touch panel. The display panel 31 displays software keys for receiving various settings and displays messages. In addition, the operation panel 203 is provided with hardware keys such as a start key 32 and a ten key 33.

Figure 3:
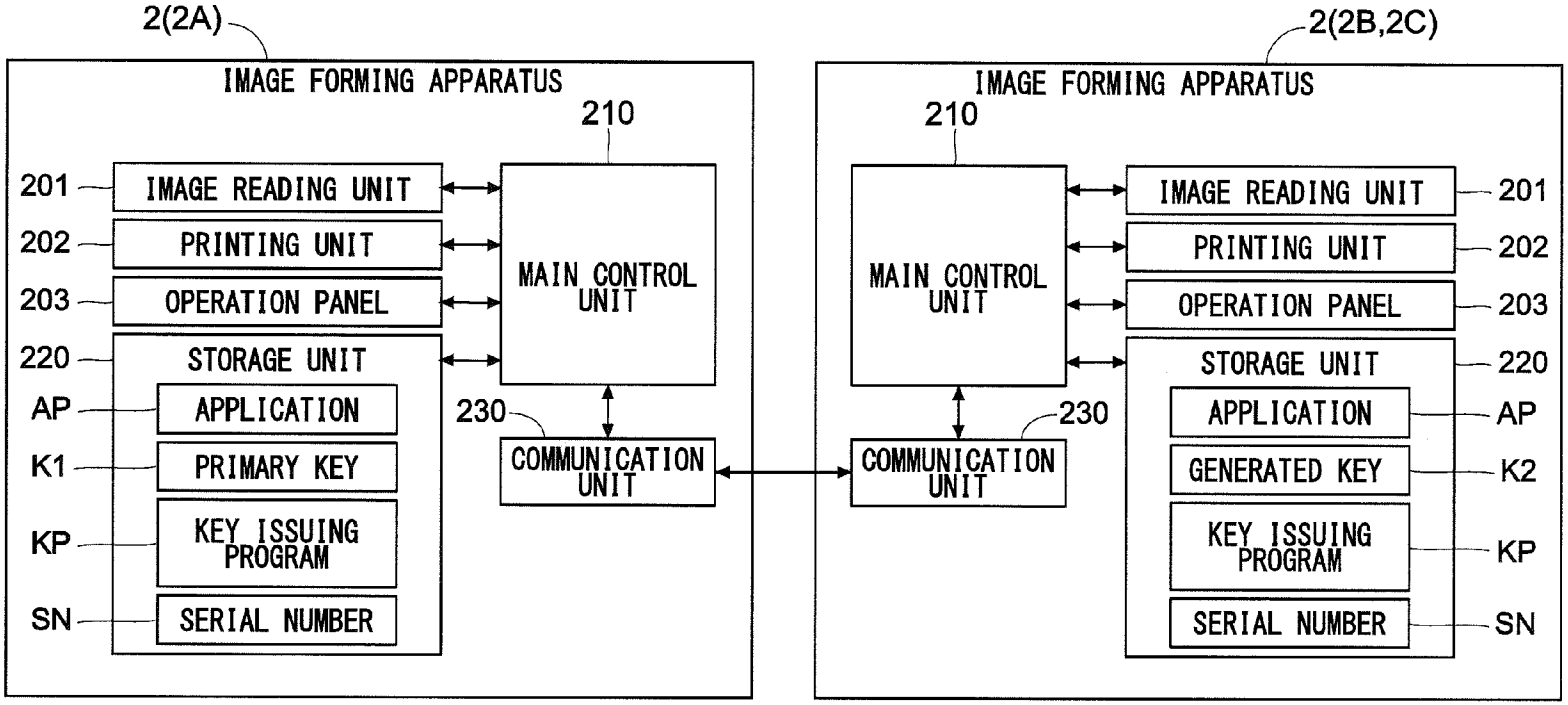
FIG. 3 is a hardware block diagram of an image forming apparatus according to an embodiment of the present disclosure.

In addition, as shown in FIG. 3, the image forming apparatus 2 includes the main control unit 210. Note that the main control unit 210 corresponds to a "control unit". The main control unit 210 controls operations of individual units of the image forming apparatus 2 (the image reading unit 201, the printing unit 202, the operation panel 203, and the like). In addition, the main control unit 210 performs various image processing (enlargement/contraction, density conversion, data format conversion, and the like) on the image data.

This main control unit 210 is connected to a storage unit 220 and a communication unit 230. The storage unit 220 stores control programs and data. In addition, the storage unit 220 stores the application AP for function extension. Further, the main control unit 210 controls operations of individual units of the image forming apparatus 2 on the basis of the programs and data stored in the storage unit 220.

The communication unit 230 is connected to another image forming apparatus 2 in the local network LN in a communicable manner, and sends and receives various data on the basis of an instruction from the main control unit 210. Alternately, the communication unit 230 communicates with external equipment outside the local network LN.

For instance, the communication unit 230 communicates with the activation key issuing system AS that is external equipment via the IP network NW (see FIG. 1). In this way, the image forming apparatus 2 can be provided with the activation key from the activation key issuing system AS. In addition, when the application AP is installed in the image forming apparatus 2 after the image forming apparatus 2 is shipped, communication is performed between the application server (not shown) for storing the application AP and the communication unit 230 so that the application AP is downloaded from the application server to the image forming apparatus 2. Note that it is possible to store the application AP in a portable storage medium such as a USB memory and to download the application AP from the portable storage medium to image forming apparatus 2.

Here, among the plurality of image forming apparatuses 2 in the image forming system 1, any one image forming apparatus 2 (a user thereof) requests for issue of the activation key to the activation key issuing system AS, and then the activation key issuing system AS generates and issues the activation key. Then, the activation key (key file) is stored in the storage unit 220 of the image forming apparatus 2 of the requester. In the following description, the activation key issued by the activation key issuing system AS may be referred to as a primary key K1. FIG. 3 shows a state, as an example, in which the image forming apparatus 2A stores the primary key K1.

Note that the primary key K1 contains a key main body (protect release key) for releasing protection of the application AP as well as primary key information concerning the primary key K1. For instance, the primary key information contains a signature indicating that the primary key K1 is officially issued from the activation key issuing system AS and the date and time when the primary key K1 is issued. In addition, if the license of the application AP corresponding to the primary key K1 has an expiration date, the primary key information also includes the expiration date of the license of the application AP.

In addition, each of the storage units 220 of the plurality of image forming apparatuses 2 stores a key issuing program KP for additionally issuing the activation key based on the primary key K1. This key issuing program KP is a program for performing a calculation similar to that performed by the activation key issuing system AS when issuing the key.

Further, among the plurality of image forming apparatuses 2, the image forming apparatus 2 that possesses the primary key K1 receives an instruction to issue the activation key, and then generates and issues the activation key that can be used in another image forming apparatus 2 in the local network LN on the basis of the primary key K1 and the key issuing program KP. In this way, after any one image forming apparatus 2 in the local network LN stores the primary key K1, it is possible to obtain the activation key that can be used in another image forming apparatuses 2 in the local network LN without accessing to the activation key issuing system AS. In the following description, the activation key generated and issued by the image forming apparatus 2 in the local network LN may be referred to as an internally generated key K2. FIG. 3 shows a state, as an example, in which the image forming apparatuses 2B and 2C store the internally generated keys K2.

<Issue of Activation Key by Activation Key Issuing System>

Hereinafter, with reference to a flowchart shown in FIG. 4, there is described a flow in which the activation key issuing system AS issues the activation key.

Figure 4:
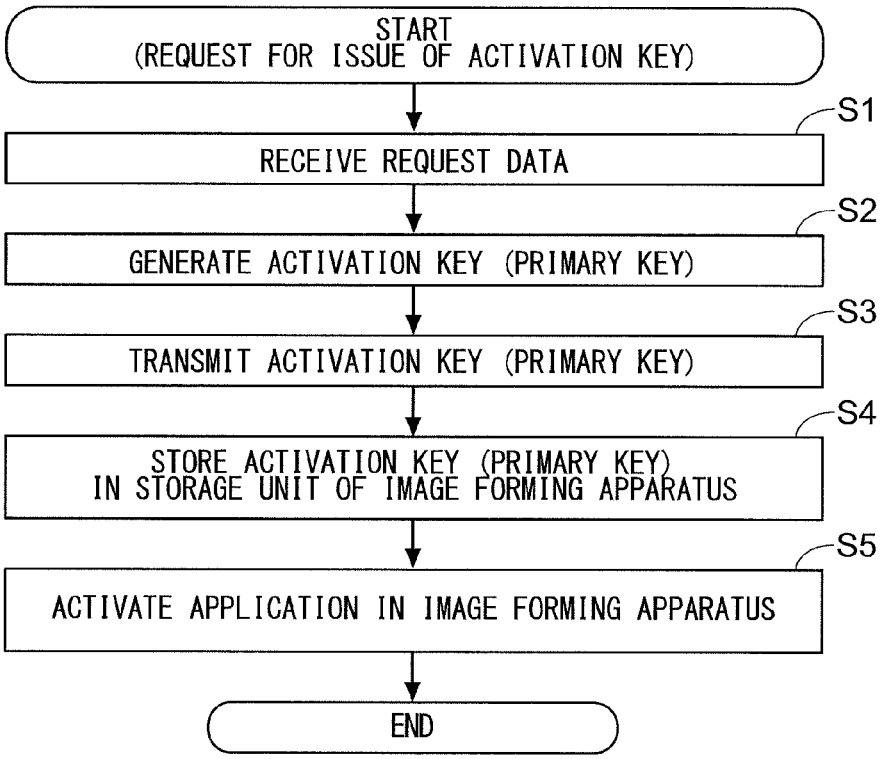
FIG. 4 is a flowchart for illustrating a flow of receiving an issue of an activation key (primary key), from outside of a local network, which can be used in an image forming apparatus according to an embodiment of the present disclosure.

The flowchart shown in FIG. 4 starts when an operator of activation requests for issue of the activation key to the activation key issuing system AS. When requesting for issue of the activation key, the operator of activation performs an input operation necessary for requesting for issue of the activation key with the operation panel 203 of the image forming apparatus 2 in which the activation of the application AP is performed first among the plurality of image forming apparatuses 2. The communication unit 230 of the image forming apparatus 2 of the requester, to which the input operation is performed, transmits request data concerning the request for issue of the activation key to the activation key issuing system AS via the IP network NW.

The request data contains various information such as a type and ID of the application AP, and a serial number SN (production number) of the image forming apparatus 2 of the requester. For instance, the serial number SN of the image forming apparatus 2, which is unique to the apparatus, is stored in the storage unit 220 of each apparatus (see FIG. 3). Note that other information may be contained in the request data.

When the operator of activation performs the request for issue of the activation key, the activation key issuing system AS receives the request data from the image forming apparatus 2 of the requester in Step S1.

Further, in Step S2, the activation key issuing system AS generates the activation key (primary key K1) that can be used only in the image forming apparatus 2 of the requester on the basis of a predetermined arithmetic expression using the serial number SN of the image forming apparatus 2 of the requester contained in the request data. Note that the request for issue of the primary key K1 can be performed by any one of the plurality of image forming apparatuses 2, but the serial number SN is different among the apparatuses. Accordingly, when a plurality of image forming apparatuses 2 respectively perform the request for issue of the primary key K1, the primary key K1 is different among the plurality of image forming apparatuses 2. In other words, the primary key K1 generated when the image forming apparatus 2A is the requester is different from the primary key K1 generated when the image forming apparatus 2B or 2C is the requester.

After generating the primary key K1, the activation key issuing system AS transmits the primary key K1 to the image forming apparatus 2 of the requester in Step S3. Then, in Step S4, the main control unit 210 of the image forming apparatus 2 of the requester controls the storage unit 220 to store the primary key K1 received by the communication unit 230.

After that, in Step S5, the main control unit 210 of the image forming apparatus 2 of the requester performs activation of the application AP corresponding to the key on the basis of the primary key K1 stored in the storage unit 220. In this way, the application AP can be used in the image forming apparatus 2 of the requester.

<Issue of Activation Key by Image Forming Apparatus>

The image forming apparatus 2 that can use the primary key K1 among the plurality of image forming apparatuses 2 is only the image forming apparatus 2 that possesses the primary key K1 (hereinafter may be referred to as a first image forming apparatus 2). Accordingly, in order to perform activation of the application AP in another image forming apparatus 2 different from the first image forming apparatus 2 among the plurality of image forming apparatuses 2 (hereinafter may be referred to as a second image forming apparatus 2), it is necessary to obtain another activation key that can be used in the second image forming apparatus 2.

For instance, by performing the request for issue of the primary key K1 to the activation key issuing system AS in each of the plurality of image forming apparatuses 2, it is possible to obtain each primary key K1 for each apparatus. However, this operation of performing the request for issue of the primary key K1 in each of the plurality of image forming apparatuses 2 needs to prepare an environment for enabling the plurality of image forming apparatuses 2 to connect to the outside network, which is burdensome.

In addition, it is necessary to make each of the plurality of image forming apparatuses 2 connect to the outside network and to perform an input operation for the request for issue of the primary key K1 in each of the plurality of image forming apparatuses 2, which are bothering and burdensome for the operator of activation. In addition, when the request for issue of the primary key K1 is performed in the plurality of image forming apparatuses 2 one by one, it takes time until the activation is completed in all the image forming apparatuses 2. Accordingly, as the number of the image forming apparatuses 2 is larger, the load on the operator of activation becomes larger.

In addition, if a communication failure or the like occurs in the outside network, it takes time from the request for issue of the primary key K1 to the activation key issuing system AS until issuing. Otherwise, the request for issue may not be accepted.

Note that the request for issue of the primary key K1 may be performed by telephone, facsimile, electronic mail, or the like. In this case, however, the load on the operator of activation becomes larger.

In addition, for the provider of the activation key, in order to promptly respond to the request for issue of the activation key, it is necessary to prepare a system having processing ability that does not go down even if accesses to the activation key issuing system AS are concentrated. For this reason, cost loads on the provider of the activation key are large.

Accordingly, in this embodiment, the first image forming apparatus 2 that possesses the primary key K1 can issue the activation key that can be used in the second image forming apparatus 2.

Hereinafter, with reference to FIGS. 5 to 7, there is described a flow in which the first image forming apparatus 2 issues the activation key, and the second image forming apparatus 2 activates the application AP. Note that FIG. 7 shows an example in which the image forming apparatus 2A is regarded as the first image forming apparatus 2 and the image forming apparatuses 2B and 2C are regarded as the second image forming apparatus 2.

Figure 5:
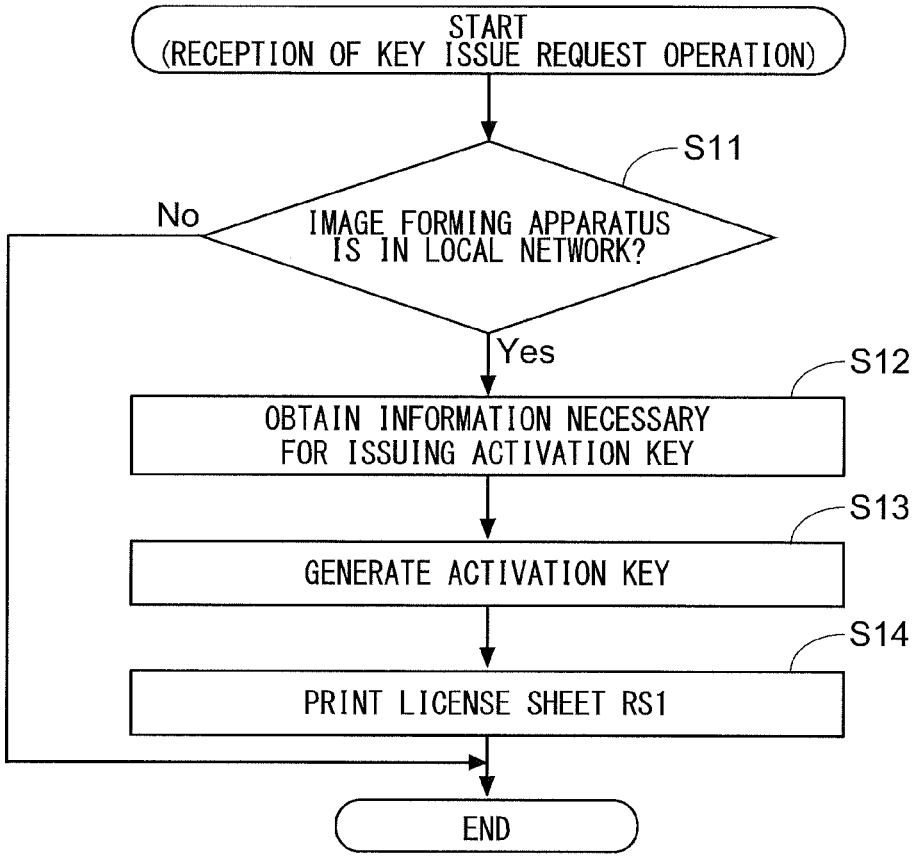
FIG. 5 is a flowchart for illustrating a flow of issuing the activation key in an image forming apparatus (first image forming apparatus) so that another image forming apparatus (second image forming apparatus) uses the activation key according to an embodiment of the present disclosure.
Figure 7:
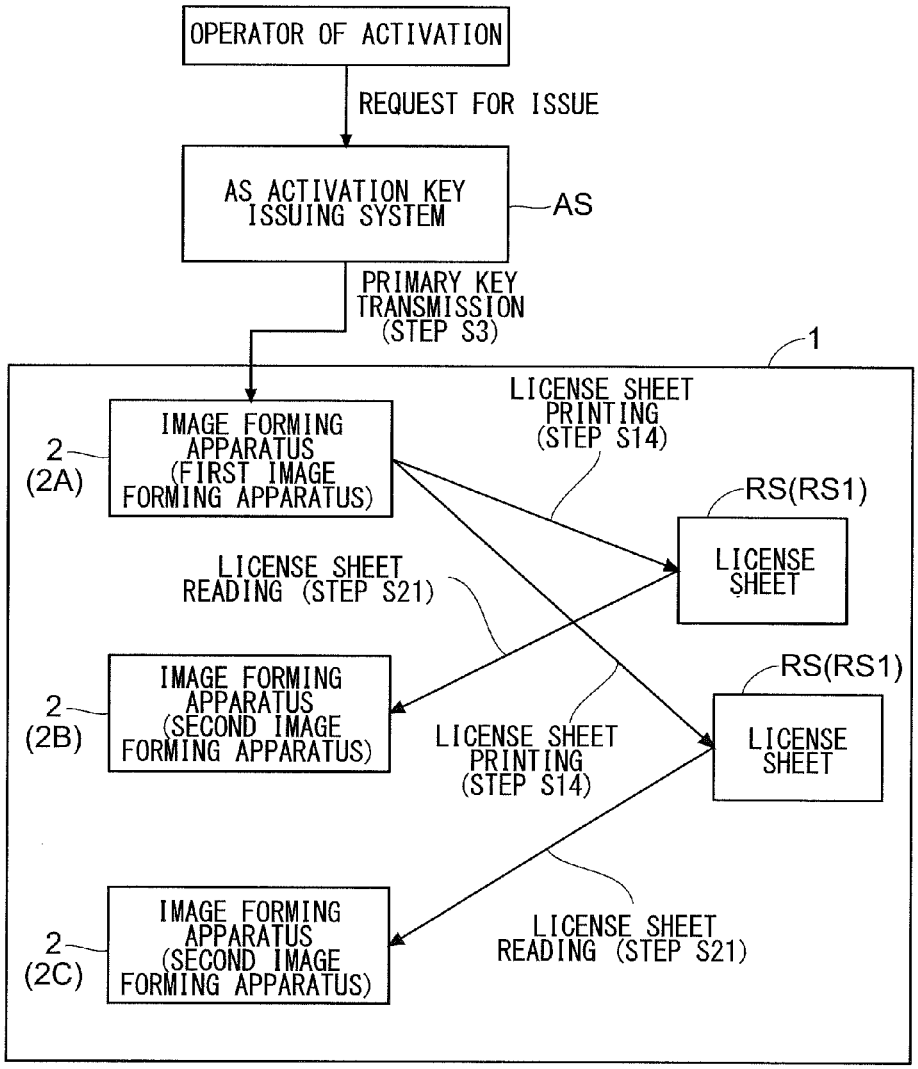
FIG. 7 is a diagram for illustrating a process performed in accordance with the flow of FIGS. 5 and 6.

First, with reference to FIGS. 5 and 7, there is described a flow in which a license sheet RS (RS1) is printed, which is necessary for activation of the application AP in the second image forming apparatus 2. The flowchart shown in FIG. 5 starts when an input operation for instructing to issue the activation key that can be used in the second image forming apparatus 2 (key issue request operation) is performed with the operation panel 203 of the first image forming apparatus 2. At this time, the operation panel 203 of the first image forming apparatus 2 displays a screen (not shown) for inputting various information. In this screen, for example, information such as an identifier (address) of the second image forming apparatus 2 to be a destination of the issued activation key, and information such as a type or ID of the application AP to be activated are input.

When receiving the instruction to issue the activation key, the main control unit 210 of the first image forming apparatus 2 checks in Step S11 whether or not the image forming apparatus corresponding to the input identifier (address) is in the local network LN, namely, whether or not the image forming apparatus corresponding to the input identifier is the second image forming apparatus 2. For instance, each of the storage units 220 of the plurality of image forming apparatuses 2 stores a range of the network address of the local network LN. Further, the main control unit 210 of the first image forming apparatus 2 refers to a network range stored in the storage unit 220 and determines whether or not the image forming apparatus corresponding to the input identifier is in the local network LN.

As a result of this checking, if the image forming apparatus corresponding to the input identifier is not in the local network LN (if the image forming apparatus corresponding to the input identifier is not the second image forming apparatus 2), this flow finishes. In other words, when the main control unit 210 of the first image forming apparatus 2 receives the instruction to issue the activation key to be used in another image forming apparatus outside the local network LN to which the first image forming apparatus 2 belongs, the main control unit 210 does not generate the activation key. On the other hand, if the image forming apparatus corresponding to the input identifier is in the local network LN (if the image forming apparatus corresponding to the input identifier is the second image forming apparatus 2), the process proceeds to Step S12.

In Step S12, the main control unit 210 of the first image forming apparatus 2 instructs the communication unit 230 to communicate with the second image forming apparatus 2. Then, information necessary for issuing the activation key is obtained from the second image forming apparatus 2. The obtained information contains, for example, the serial number SN of the second image forming apparatus 2 and the like.

Further, in Step S13, the main control unit 210 of the first image forming apparatus 2 uses the serial number SN of the second image forming apparatus 2 to perform calculation based on a predetermined arithmetic expression (key issuing program KP), and generates the activation key as a character string containing alphabet letters and numerals.

Next, in Step S14, the main control unit 210 of the first image forming apparatus 2 controls the printing unit 202 to print the license sheet RS (RS1). At this time, the printing unit 202 outputs the license sheet RS1 on which the generated key information is printed, which is information about the activation key generated in the main control unit 210. Note that the generated key information contains information (character string constituting the key main body) to be input to the second image forming apparatus 2 when using the activation key generated by the first image forming apparatus 2 in the second image forming apparatus 2. In addition, the generated key information is printed in a form of a bar code or a QR code (registered trademark), for example.

After the license sheet RS1 is printed from the first image forming apparatus 2, in order to activate the target application AP in the second image forming apparatus 2, it is necessary to input the generated key information to the second image forming apparatus 2.

Figure 6:
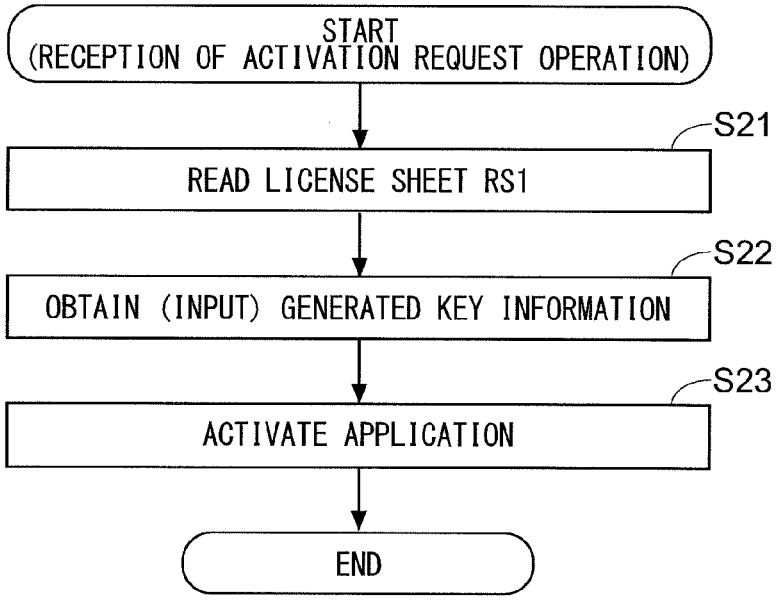
FIG. 6 is a flowchart for illustrating a flow of issuing the activation key in an image forming apparatus (first image forming apparatus) so that another image forming apparatus (second image forming apparatus) uses the activation key according to an embodiment of the present disclosure.

Next, with reference to FIGS. 6 and 7, there is described a flow in which the application AP is activated by the second image forming apparatus 2.

It is supposed that the license sheet RS1 is set on the contact glass 201*a* of the image reading unit 201 of the second image forming apparatus 2 when the flowchart shown in FIG. 6 is started. Further, when the input operation (activation request operation) for instructing activation of the application AP is performed with the operation panel 203 of the second image forming apparatus 2, the flowchart shown in FIG. 6 is started. Note that the activation request operation is substantially the same as an operation for starting scanning (to press the start key 32 of the operation panel 203), for example. However, before pressing the start key 32 of the operation panel 203, an operation for recognizing that this is scanning of the license sheet RS1 is performed with the operation panel 203.

In Step S21, the main control unit 210 of the second image forming apparatus 2 controls the image reading unit 201 to read the license sheet RS1. Further, in Step S22, the main control unit 210 of the second image forming apparatus 2 obtains the generated key information by reading the license sheet RS1 with the image reading unit 201. In other words, by the reading of the license sheet RS1 performed here, the generated key information is input to the second image forming apparatus 2, and the activation key (internally generated key K2) based on the generated key information is stored in the storage unit 220 of the second image forming apparatus 2.

After that, in Step S23, the main control unit 210 of the second image forming apparatus 2 performs activation of the application AP on the basis of the activation key stored in the storage unit 220. In this way, the application AP can be used in the second image forming apparatus 2.

Note that the character string itself constituting the activation key (key main body) may be printed on the license sheet RS1. In this case, the activation of the application AP may be performed by inputting the character string constituting the activation key (key main body) to the operation panel 203 of the second image forming apparatus 2.

Here, the primary key K1 possessed by the first image forming apparatus 2 also contains license information indicating the number of licenses of the activation keys that can be additionally issued. For instance, if the number of licenses indicated in the license information is two, the activation keys of two licenses can be additionally issued. In this case, supposing that the first image forming apparatus 2 is the image forming apparatus 2A while the second image forming apparatuses 2 are the image forming apparatuses 2B and 2C, the image forming apparatus 2A can issue the activation key for the image forming apparatus 2B and the activation key for the image forming apparatus 2C.

It is supposed that the number of licenses indicated in the license information is one. In this case, if the activation key that can be used in one of the image forming apparatuses 2B and 2C is already issued, the activation key that can be used in the other image forming apparatus cannot be issued. In other words, when the main control unit 210 of the first image forming apparatus 2 receives the instruction to issue the activation key after generating activation keys of the number of licenses indicated in the license information, the main control unit 210 does not generate the activation key.

<Transfer of Primary Key>

Among the plurality of image forming apparatuses 2 in the local network LN, only one image forming apparatus 2 can possess the primary key K1. However, the image forming apparatus 2 that possesses the primary key K1 may be broken down and may be removed from the local network LN. Otherwise, the image forming apparatus 2 that possesses the primary key K1 may be removed from the local network LN because of restructuring of the local network LN or other reason. In this case, the activation key cannot be issued in the local network LN.

For this reason, in this embodiment, the first image forming apparatus 2 can transfer the primary key K1 to the second image forming apparatus 2. When this transfer of the primary key K1 is performed, the transfer source of the primary key K1 changes from the first image forming apparatus 2 to the second image forming apparatus 2, and the transfer destination of the primary key K1 changes from the second image forming apparatus 2 to the first image forming apparatus 2. In addition, for example, the transfer of the primary key K1 from the first image forming apparatus 2 to the second image forming apparatus 2 is performed together with the activation of the application AP in the second image forming apparatus 2.

Hereinafter, with reference to FIGS. 8 to 10, there is described a flow in which the primary key K1 is transferred from the first image forming apparatus 2 to the second image forming apparatus 2, and the activation of the application AP is performed in the second image forming apparatus 2. Note that FIG. 10 shows an example in which the image forming apparatus 2A is the first image forming apparatus 2 while the image forming apparatuses 2B and 2C are the second image forming apparatuses 2, and the primary key K1 is transferred from the image forming apparatus 2A to the image forming apparatus 2C. However, for convenience sake, the image forming apparatus 2B as the second image forming apparatus 2 is not shown.

Figure 8:
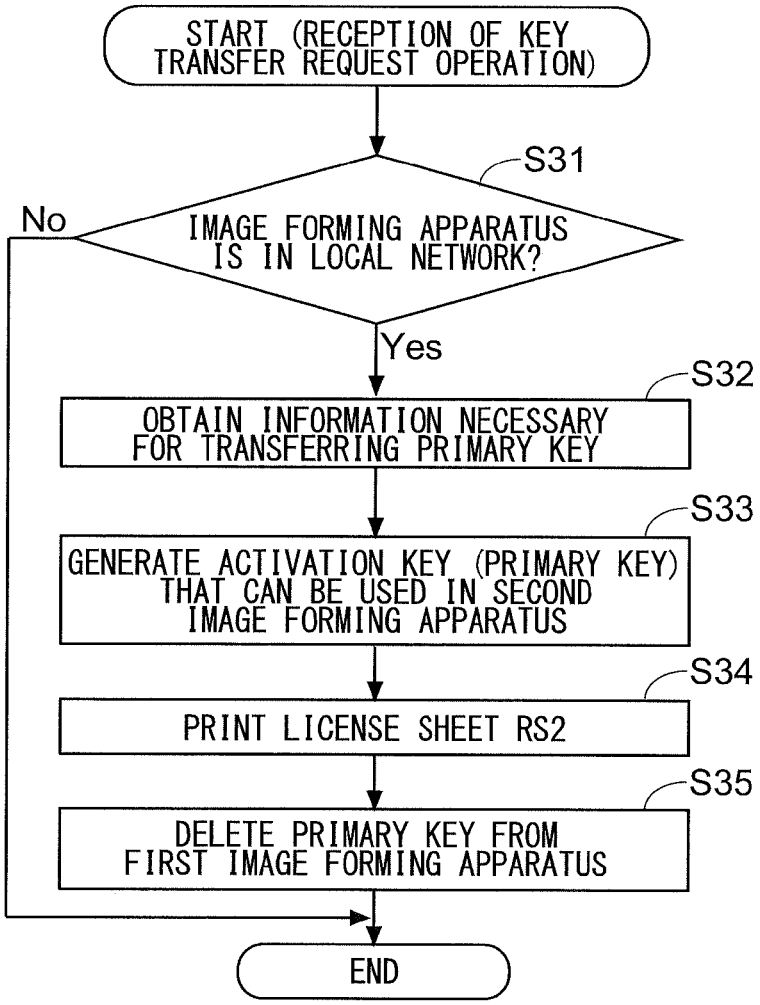
FIG. 8 is a flowchart for illustrating a flow of transferring the activation key (primary key) possessed by the image forming apparatus (first image forming apparatus) to another image forming apparatus (second image forming apparatus) according to an embodiment of the present disclosure.

First, with reference to FIGS. 8 and 10, there is described a flow in which a license sheet RS (RS2) is printed, which is necessary for transferring the primary key K1 from the first image forming apparatus 2 to the second image forming apparatus 2. The flowchart shown in FIG. 8 starts when an input operation (key transfer request operation) for instructing to transfer the primary key K1 from the first image forming apparatus 2 to the second image forming apparatus 2 is performed with the operation panel 203 of the first image forming apparatus 2. At this time, the operation panel 203 of the first image forming apparatus 2 displays a screen (not shown) for inputting various information. In this screen, information such as an identifier (address) of the second image forming apparatus 2 to be the transfer destination of the primary key K1 and information such as an a type or ID of the application AP corresponding to the primary key K1 are input, for example. Note that these various types of information are substantially the same as information in the key issue request operation (input operation for instructing to issue the activation key that can be used in the second image forming apparatus 2).

When receiving the instruction to transfer the primary key K1, the main control unit 210 of the first image forming apparatus 2 checks in Step S31 whether or not the image forming apparatus corresponding to the input identifier (address) is in the local network LN, namely, whether or not the image forming apparatus corresponding to the input identifier is the second image forming apparatus 2. A method of checking here is the same as that in Step S11 of the flowchart shown in FIG. 5, for example.

As a result of this checking, if the image forming apparatus corresponding to the input identifier is not in the local network LN (if the image forming apparatus corresponding to the input identifier is not the second image forming apparatus 2), this flow is finished. On the other hand, if the image forming apparatus corresponding to the input identifier is in the local network LN (if the image forming apparatus corresponding to the input identifier is the second image forming apparatus 2), the process proceeds to Step S32.

In Step S32, the main control unit 210 of the first image forming apparatus 2 instructs the communication unit 230 to communicate with the second image forming apparatus 2. Then, information (e.g., the serial number SN of the second image forming apparatus 2) necessary for transferring the primary key K1 is obtained from the second image forming apparatus 2. The information obtained here is substantially the same as that in Step S12 of the flowchart shown in FIG. 5, for example.

Further, in Step S33, the main control unit 210 of the first image forming apparatus 2 uses the serial number SN of the second image forming apparatus 2 to perform calculation based on the predetermined arithmetic expression (key issuing program KP), and generates the activation key as a character string containing alphabet letters and numerals (the primary key K1 that can be used in the second image forming apparatus 2).

Next, in Step S34, the main control unit 210 of the first image forming apparatus 2 controls the printing unit 202 to print the license sheet RS (RS2). At this time, the printing unit 202 outputs the license sheet RS2 on which the information as a combination of primary key information concerning the primary key K1 stored in the storage unit 220 and the generated key information is printed (e.g., in a form of a bar code or a QR code (registered trademark)). Note that the primary key information contains information to be input in the second image forming apparatus 2 when the primary key K1 stored in the first image forming apparatus 2 is transferred to the second image forming apparatus 2. For instance, the primary key information contains a signature indicating that the primary key K1 is officially issued.

After that, in Step S35, the main control unit 210 of the first image forming apparatus 2 deletes the primary key K1 from the storage unit 220.

After the license sheet RS2 is printed from the first image forming apparatus 2, in order to activate the target application AP in the second image forming apparatus 2 and to transfer the primary key K1 to the second image forming apparatus 2, it is necessary to input the primary key information and the generated key information to the second image forming apparatus 2.

Figure 9:
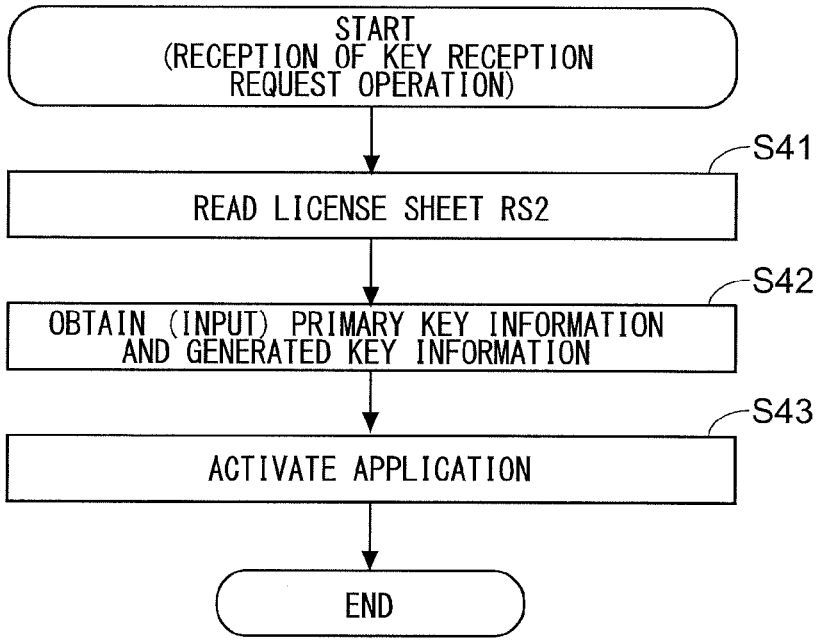
FIG. 9 is a flowchart for illustrating a flow of transferring the activation key (primary key) possessed by the image forming apparatus (first image forming apparatus) to another image forming apparatus (second image forming apparatus) according to an embodiment of the present disclosure.
Figure 10:
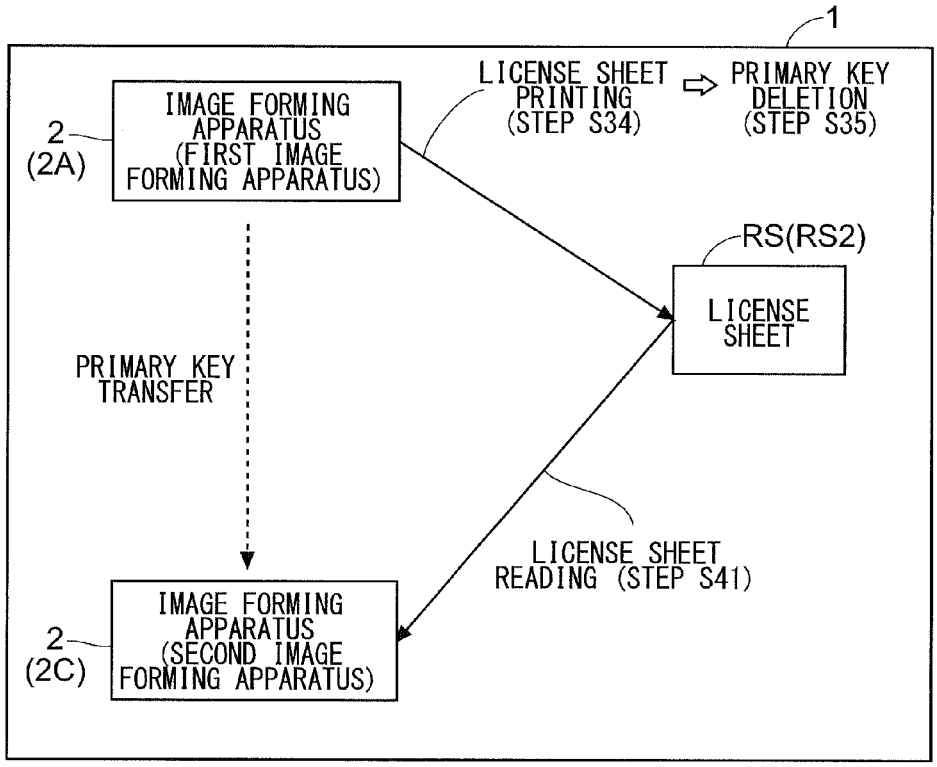
FIG. 10 is a diagram for illustrating a process performed in accordance with the flow of FIGS. 8 and 9.

Next, with reference to FIGS. 9 and 10, there is described a flow in which the primary key K1 is transferred to the second image forming apparatus 2 and the application AP is activated in the second image forming apparatus 2.

It is supposed that the license sheet RS2 is set on the contact glass 201*a* of the image reading unit 201 of the second image forming apparatus 2 when the flowchart shown in FIG. 9 starts. Further, when an input operation (key reception request operation) for instructing to receive the primary key K1 is performed with the operation panel 203 of the second image forming apparatus 2, the flowchart shown in FIG. 9 starts. Note that the key reception request operation is substantially the same as the operation for starting the scan, for example (operation of pressing the start key 32 of the operation panel 203). However, before pressing the start key 32 of the operation panel 203, an operation for recognizing that this is scanning of the license sheet RS2 is performed with the operation panel 203.

In Step S41, the main control unit 210 of the second image forming apparatus 2 controls the image reading unit 201 to read the license sheet RS2. Then, in Step S42, the main control unit 210 of the second image forming apparatus 2 obtains the primary key information and the generated key information by reading the license sheet RS2 with the image reading unit 201. In other words, by the reading of the license sheet RS2 performed here, the primary key information and the generated key information are input to the second image forming apparatus 2, and the activation key based on the primary key information and the generated key information is stored in the storage unit 220 of the second image forming apparatus 2. In this way, the activation key stored in the storage unit 220 of the second image forming apparatus 2 becomes the primary key K1. As a result, the primary key K1 is transferred from the first image forming apparatus 2 to the second image forming apparatus 2.

After that, in Step S43, the main control unit 210 of the second image forming apparatus 2 performs the activation of the application AP based on the activation key stored in the storage unit 220. In this way, the application AP can be used in the second image forming apparatus 2.

Note that if the application AP corresponding to the primary key K1 is already activated in the second image forming apparatus 2 to be the transfer destination of the primary key K1, only the transfer of the primary key K1 to the second image forming apparatus 2 can be performed. In this case, for example, the license sheet RS indicating only the primary key information is printed. Then, by performing the reading of this license sheet RS in the second image forming apparatus 2, the activation key (internally generated key K2) stored in the second image forming apparatus 2 can be handled as the primary key K1. In other words, this means that the primary key K1 is transferred from the first image forming apparatus 2 to the second image forming apparatus 2.

The first image forming apparatus 2 included in the image forming system 1 of this embodiment includes the storage unit 220 for storing the primary key K1 that is the activation key issued by the external official activation key issuing system AS and the key issuing program KP for additionally issuing the activation key based on the primary key K1, the operation panel 203 (reception unit) for receiving the instruction to issue the activation key that can be used in the image forming apparatus 2 in which the inactivated application is installed, i.e., the second image forming apparatus 2 other than the first image forming apparatus 2 in the local network LN to which the first image forming apparatus 2 belongs, the main control unit 210 configured to generate the activation key that can be used in the second image forming apparatus 2 on the basis of the primary key K1 and the key issuing program KP when the operation panel 203 receives the instruction to issue the activation key, and the printing unit 202 configured to print on the license sheet RS (sheet) the generated key information to be input in the second image forming apparatus 2 when the activation key generated by the main control unit 210 is used in the second image forming apparatus 2.

With the structure of this embodiment, after receiving the activation key (primary key K1) issued from the activation key issuing system AS, the image forming apparatus 2 that stores the primary key K1 can issue the activation key that can be used in another image forming apparatus 2 in the same local network LN. For this reason, when activating the application AP installed in each of the plurality of image forming apparatuses 2 in the local network LN, it is necessary to communicate with the activation key issuing system AS for the activation of the application AP of the first apparatus, but it is not necessary to communicate with the activation key issuing system AS for the activation of the application AP of the second and following apparatuses because the first image forming apparatus 2 (storing the primary key K1) can issue the activation key. In this way, it is sufficient that only one of the image forming apparatuses 2 can be connected to the outside network. In other words, it is not necessary to prepare environment for every one of the plurality of image forming apparatuses 2 to connect to the outside network.

In addition, even if every one of the plurality of image forming apparatuses 2 performs the activation of the application AP, it is sufficient that only one apparatus should request for issue of the activation key to the activation key issuing system AS. Then, because only one apparatus should request for issue of the activation key, work time for the activation can be shortened. In this way, load on the operator of activation is reduced.

Further, in this case, because accesses to the activation key issuing system AS are decreased, system down due to concentration of accesses to the activation key issuing system AS hardly occurs. Accordingly, for the provider of the activation key, equipment investment for improving capacity of the activation key issuing system AS can be reduced so that cost can be reduced.

In addition, as described above, the main control unit 210 of the first image forming apparatus 2 of this embodiment does not generate the activation key even if the operation panel 203 receives the instruction to issue the activation key that is used in another image forming apparatus outside the local network LN. Further, in this embodiment, the activation key (primary key K1) possessed by the first image forming apparatus 2 contains license information indicating the number of licenses of the activation keys that can be additionally issued. After the activation keys of the number of licenses indicated in the license information are generated, the main control unit 210 of the first image forming apparatus 2 does not issue the activation key even if the operation panel 203 receives the instruction to issue the activation key. In this way, unlimited issuing of the activation key can be prevented.

In addition, as described above, the communication unit 230 of the first image forming apparatus 2 of this embodiment obtains the serial number SN of the second image forming apparatus 2 from the second image forming apparatus 2 when the operation panel 203 receives the instruction to issue the activation key. Further, the main control unit 210 of the first image forming apparatus 2 uses the serial number SN of the second image forming apparatus 2 to perform the calculation based on the predetermined arithmetic expression, and generates the activation key that can be used in the second image forming apparatus 2. In this way, it is easy to generate the activation key that can be used only in the second image forming apparatus 2 to be the destination of the activation key. In other words, it is possible to prevent the activation key generated by the first image forming apparatus 2 from being used in an unintentional image forming apparatus.

In addition, as described above, when the operation panel 203 of the first image forming apparatus 2 of this embodiment receives the instruction to transfer the primary key K1 to the second image forming apparatus 2, the printing unit 202 of the first image forming apparatus 2 prints on the license sheet RS the primary key information to be input to the second image forming apparatus 2 when transferring the primary key K1 to the second image forming apparatus 2. In addition, after finishing printing of the primary key information by the printing unit 202 of the first image forming apparatus 2, the main control unit 210 of the first image forming apparatus 2 deletes the primary key K1 from the storage unit 220 of the first image forming apparatus 2. In this way, when the first image forming apparatus 2 is removed from the local network LN, the primary key K1 is transferred from the first image forming apparatus 2 to the second image forming apparatus 2. Thus, the activation key can be continuously issued by the image forming apparatus 2 in the local network LN (that is changed from the second image forming apparatus 2 to the first image forming apparatus 2 after receiving the transfer of the primary key K1).

In addition, as described above, the printing unit 202 of the first image forming apparatus 2 of this embodiment prints the license sheet RS. Then, the image reading unit 201 of the second image forming apparatus 2 reads the image printed on the license sheet RS (such as the generated key information and the primary key information) so as to input the generated key information and the primary key information to the second image forming apparatus 2. In this way, when using the activation key in the second image forming apparatus 2 (or when transferring the primary key K1 to the second image forming apparatus 2), it is possible to save time and effort to input various information to the second image forming apparatus 2, which is convenient for the operator of activation.

The embodiments described above are merely examples in all aspects and should not be interpreted as limitations. The scope of the present disclosure is defined not by the embodiments described above but by the claims, in which all modifications within meanings and ranges equivalent to the claims are included.

What is claimed is:

1. An image forming apparatus comprising:

a storage unit for storing a primary key as an activation key issued from an external official activation key issuing system and for storing a key issuing program for additionally issuing the activation key based on the primary key;

a reception unit for receiving an instruction to issue the activation key that can be used in another image forming apparatus belonging to the same local network as the image forming apparatus, the another image forming apparatus being installed with an inactivated application;

a control unit configured to generate the activation key that can be used in the another image forming apparatus, on the basis of the primary key and the key issuing program, when the reception unit receives the instruction to issue the activation key; and a printing unit configured to print generated key information to be input to the another image forming apparatus when using the activation key generated by the control unit in the another image forming apparatus on a sheet to output the sheet.

2. The image forming apparatus according to claim 1, wherein, the control unit does not generate the activation key when the reception unit receives the instruction to issue the activation key that is used in another image forming apparatus outside the local network to which the image forming apparatus belongs.

3. The image forming apparatus according to claim 1, wherein, the primary key contains license information indicating the number of licenses of the activation keys, and after generating the activation keys of the number of licenses indicated in the license information, the control unit does not generate the activation key when the reception unit receives the instruction to issue the activation key.

4. The image forming apparatus according to claim 1, further comprising a communication unit for communicating with the another image forming apparatus, wherein the communication unit obtains a serial number of the another image forming apparatus from the another image forming apparatus when the reception unit receives the instruction to issue the activation key, and the control unit uses the serial number of the another image forming apparatus to perform calculation based on a predetermined arithmetic expression, and generates the activation key that can be used in the another image forming apparatus.

5. The image forming apparatus according to claim 1, wherein, the reception unit receives an instruction to transfer the primary key to the another image forming apparatus, when the reception unit receives the instruction to transfer the primary key to the another image forming apparatus, the printing unit prints primary key information to be input to the another image forming apparatus for transferring the primary key to the another image forming apparatus on a sheet to output the sheet, and after finishing the print out of the primary key information by the printing unit, the control unit deletes the primary key from the storage unit.

6. An image forming system comprising:

a first image forming apparatus that is the image forming apparatus according to claim 1; and a second image forming apparatus that is an image forming apparatus in which an inactivated application is installed and is an image forming apparatus other than the first image forming apparatus, belonging to the same local network as the first image forming apparatus, wherein the second image forming apparatus activates the application when the generated key information is input to the second image forming apparatus.

7. The image forming system according to claim 6, the second image forming apparatus includes an image reading unit for reading an image, wherein the image reading unit reads an image on the sheet on which the generated key information is printed, so as to input the generated key information to the second image forming apparatus.

* * * * *